US006901607B1

(12) United States Patent
Elwell

(10) Patent No.: US 6,901,607 B1
(45) Date of Patent: Jun. 7, 2005

(54) MEN'S BRIEF WITH INNER SUPPORT POCKET

(76) Inventor: Jean D. Elwell, 3040 Hamlin Dr., Machesney Park, IL (US) 61115

( * ) Notice: Subject to any disclaimer, the term of this patent is extended or adjusted under 35 U.S.C. 154(b) by 0 days.

(21) Appl. No.: 10/790,400

(22) Filed: Mar. 1, 2004

(51) Int. Cl.[7] ..... A41B 9/02
(52) U.S. Cl. ..... 2/403; 2/400; 602/67
(58) Field of Search ..... 2/400–405; 602/67–72

(56) References Cited

U.S. PATENT DOCUMENTS 1,615,192 A * 1/1927 Pelton ..... 602/67
2,138,481 A * 11/1938 Chatfield ..... 602/69
3,029,814 A * 4/1962 Kravitz ..... 602/67
3,037,503 A * 6/1962 Ravaschieri ..... 602/69
3,459,181 A 8/1969 Mann
4,195,630 A 4/1980 Connery
4,660,551 A * 4/1987 Nishimura ..... 600/41
5,070,869 A 12/1991 Zhang
5,647,065 A * 7/1997 Richerson ..... 2/403
5,870,779 A 2/1999 Heron
6,295,651 B1 10/2001 Kang

* cited by examiner

*Primary Examiner*—Gloria M. Hale

(57) ABSTRACT

A support pocket with a conformable pouch having an elastic back is secured to the inside front of a man's brief. A pair of flaps extending upwardly from opposite sides of the pouch are movable between a fastened closed position overlapping one another and laying flat against the inside front of the brief, and an open position separated from one another to open the pouch from above.

10 Claims, 6 Drawing Sheets

MEN'S BRIEF WITH INNER SUPPORT POCKET

CROSS-REFERENCES TO RELATED APPLICATIONS

None.

STATEMENT REGARDING FEDERALLY SPONSORED RESEARCH OR DEVELOPMENT

Not applicable.

REFERENCE TO A SEQUENCE LISTING, TABLE, OR COMPUTER PROGRAM LISTING APPENDIX SUBMITTED ON A COMPACT DISC AND INCORPORATION-BY-REFERENCE OF THE MATERIAL ON THE COMPACT DISC

Not applicable.

BACKGROUND OF THE INVENTION

1. Field of Invention

The present invention relates generally to men's undergarments.

More particularly, the invention relates to men's briefs with an inner support pocket, and which include all of the normal functions and convenience of conventional briefs.

2. Description of Related Art

There are several known drawbacks and disadvantages associated with wearing conventional men's briefs. These drawbacks and disadvantages include discomfort from chaffing, insufficient support, and the presence of moisture and/or increased warmth some men experience when wearing conventional briefs.

Several prior men's briefs attempt to provide additional support as compared with conventional briefs. Heron, U.S. Pat. No. 5,870,779 discloses a man's brief with a pouch with a complicated drawstring arrangement. Zhang, U.S. Pat. No. 5,070,869 discloses a man's brief with a support pocket that is entirely integrally sewn into the brief for receiving the man's penis only. Other brief arrangements are shown in, for example, Kang, U.S. Pat. No. 6,295,651; Connery, deceased et al., U.S. Pat. No. 4,195,630; and Mann, U.S. Pat. No. 3,459,181. However, these and other prior men's briefs tend to be either relatively complicated in construction, do not permit wearing and use with the normal functions and conveniences of conventional briefs, do not provide desired support or support considerations for differently sized and configured men, and/or do not fully address the other above-noted drawbacks and disadvantages of conventional briefs.

Wearing conventional briefs should not be uncomfortable. Accordingly, there is a need for an improved brief that that reduces the above-mentioned drawbacks and disadvantages of conventional briefs, while maintaining the normal functionality and convenience thereof to which the user has become accustomed.

In particular, there is a need for a new brief that reduces the discomfort from not having enough support, being too warm, or chafing when wearing conventional briefs.

BRIEF SUMMARY OF THE INVENTION

The general aim of the present invention is to provide a new and unique men's brief that achieves improved comfort for the wearer, while maintaining the normal functions and convenience of conventional briefs.

Another aim of the invention is to provide a new and unique men's brief that is simple and straightforward in design, implementation and use.

An important objective of the invention is to provide a men's brief with a unique inner support pocket that reduces the above-noted discomforts associated with wearing conventional briefs.

Detailed objectives of the invention are to improve support and positioning for enhanced comfort, including enhanced dryness and cooling, and to reduce chafing associated with wearing conventional briefs.

Another important objective of the invention is to provide a man's brief with the above-noted advantages and improvements, but that looks like conventional briefs from the outside.

These and other objectives and advantages of the invention will become more apparent from the following detailed description when taken in conjunction with the accompanying drawings.

A man's brief in accordance with the invention includes a conventional main body with front overlapping flaps establishing inside and outside openings for conventional convenient access when wearing the brief. The inside of the brief is provided with a support pocket comprising a lower conformable pouch connected to the inside front of the main body, and a pair of flaps that extend upwardly from the sides of the pouch. The pouch is provided with an elastic back edge that cooperates with the flaps to establish an elastic opening from the back side. The flaps are configured to overlap above the inside opening of the main body, and with a unique closure arrangement for opening and closing, for ease of putting on and taking off the brief. In typical use, the scrotum fits inside the support pouch, and the penis is positioned between the flaps and the front of the brief.

A brief with a support pocket in accordance with the invention include several specific features and advantages. There is no visible change to the brief as compared with a conventional brief, and no change to the outside of the brief. A brief incorporating the support pocket includes the same functions and conveniences of a conventional brief. The uniquely configured support pocket is designed to not interfere with any of the original functions and conveniences of the conventional brief. The support pocket provides support to the man's scrotum, and keeps this area cool, dry and away from the rest of the wearer's body. The support pocket includes an elastic center opening which fits behind and comfortably surrounds the back of the scrotum. The flaps provide a more secure, comfortable fit than conventional brief, and isolate the penis from the wearer's skin to keep the male penis away from the body, thus providing dryness and enhanced comfort, preventing chafing, and generally protecting the penis as compared with a conventional brief. The preferred support pocket includes easy to open and close snaps which provide a secure and comfortable fit all day long.

Figure 1:
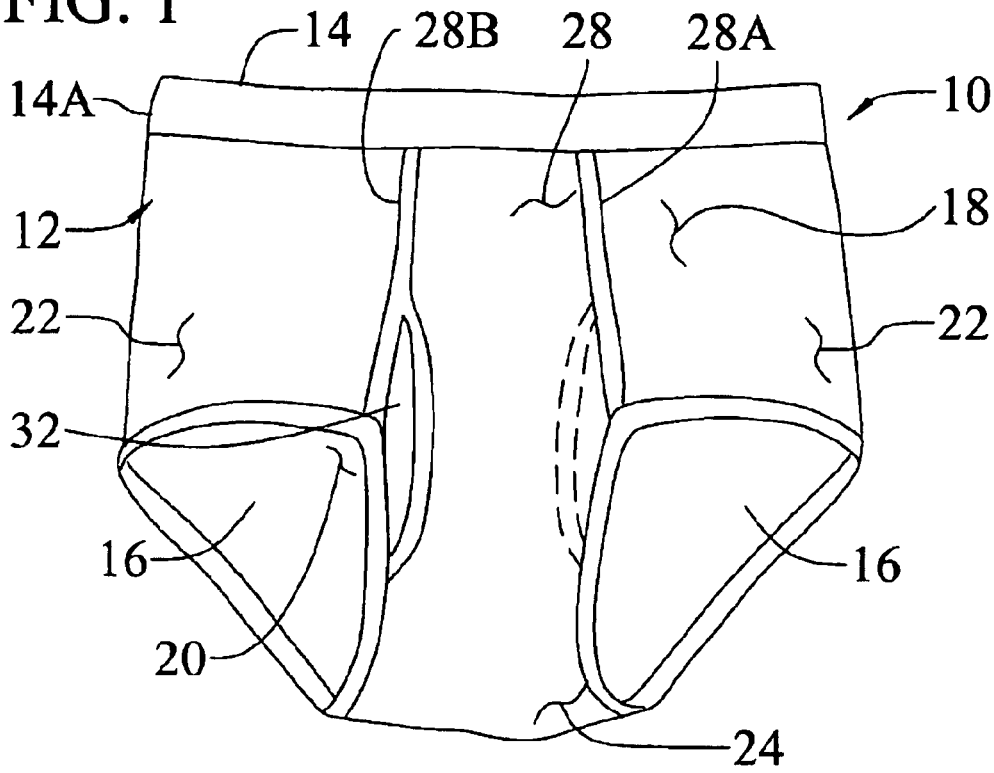
FIG. 1 is a front view of the outside of a men's brief incorporating the unique aspects of the present invention.

While the invention is susceptible of various modifications and alternative constructions, certain illustrated embodiments have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE INVENTION

Referring to FIGS. 1–5, there is shown one embodiment of a man's brief 10 in accordance with the invention. The brief 10 is constructed similar to, and includes all of the parts and components of a conventional brief. As shown in the outside front view of FIG. 1, the brief 10 appears the same as a conventional brief from the outside. The backside, although not shown, is of similar design, construction and appearance as a conventional brief. Accordingly, the brief includes a main body 12 with an elastic waist opening 14 at the top and a pair of laterally spaced lower leg openings 16 at the bottom. The main body is established with a front panel section 18, a back panel section 20, a pair of side panel sections 22, and a bottom panel section 24. The front, back and side panel sections encircle the wearer, and the bottom panel section is connected between the front and back panel sections, with side perimeter, to establish the leg openings between the bottom and side panel sections.

The front panel section 18 is provided with an inside panel 26 (FIG. 2), and an outside panel 28 (FIG. 1) that substantially overlaps the inside panel. One set of opposite side edges 26A and 28A of the inside and outside front panels, respectively, are sewn downwardly from the top elastic band 14A to the leg openings 16 as indicated to close the associated sides of the front panels. The opposite set of side edges 26B and 28B of the inside and outside front panels, respectively, are sewn downwardly from the elastic band along the upper portion of the front panel sections as indicated to establish an inside opening 30 at the lower side of the inside panel and an outside opening 32 at the opposite lower side of the outside panel. The overlapping front panels and the associated openings 30 and 32 cooperate to establish the familiar sideways openable front flaps or "fly" of the conventional brief. As with alternate configuration conventional briefs, (i) the back, sides, bottom and side portions of the front panel sections of the main body may be constructed either from a single piece of material, or from multiple pieces of material sewn together; and (ii) specific construction of the overlapping inside and outside front panels will vary between specific configuration briefs, such as the common alternate construction brief with upper and lower inside and outside "fly" openings resulting from overlapping upper and lower front panels.

In accordance with the invention, a unique inner support pocket 40 is provided on the inside of the brief 10 as shown in the inside views of the brief in FIGS. 2–5. The support pocket 40 includes a lower pouch 42, and a pair of upper flaps, shown as left flap 44 and right flap 46, that extend upwardly from opposite sides of the pouch. The support pocket is made from soft, conformable fabric, such as comfortable cotton blend material of the type typically used in men's conventional briefs. For purposes discussed below, the preferred flaps 44, 46 are made from a double layer of fabric material. This material includes, but is not limited to, a fabric with 95% soft cotton and 5% lycra.

The pouch 42 is established with a strip of material of substantially constant width, that extends from one side of the front panels 26, 28 to the other side on the inside of the brief, and that is gathered along the inside edge 50. The pocket includes a front center length that establishes the front edge 48 (see FIG. 6A) of the pouch, and a back center length that established the back edge 50 of the pouch. The front edge of the pouch is sewn along a generally semi-circular curvature that extends downwardly along one side of the front panels, arcuately sideways along the front portion of the bottom panel section, and then curving back upwardly along the opposite side of the front panels to generally encircle, on the sides and below, the inside openings 30, 32 such that the wearer has normal access to the openings 30 and 32 from inside the pocket. An elastic strip is sewn into the back edge 50 of the pouch. The elastic strip is shorter than the back center length of material defining the back edge of the pouch to cause the back edge to gather and establish an elastic, conformable inside edge to the pouch. With the curved front edge 48, the elastic strip draws the back edge of the pouch upwardly, creating a pouch form that curves gently upwardly upon progressing from side to side, for approximately 180, or at least semi-circularly, around the side of the brief front, and upon progressing from the front panels back towards the wearer.

Figure 2:
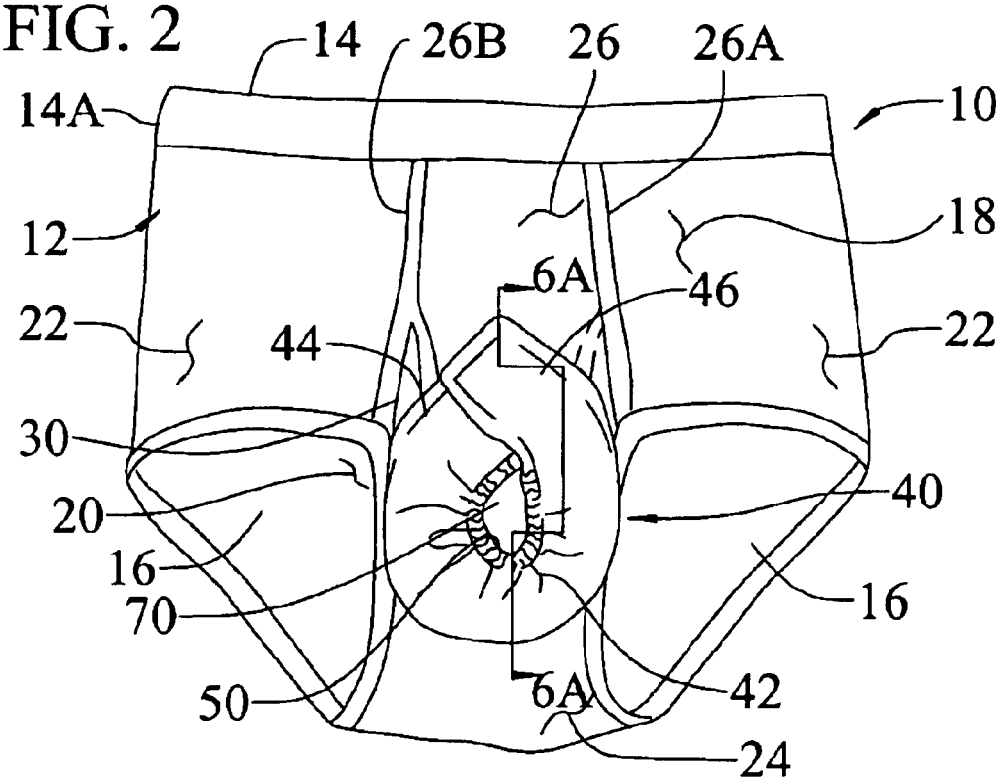
FIG. 2 is a front view of the inside of the men's brief shown in FIG. 1, the brief being shown as turned inside-out for viewing the inside thereof, and showing an integral internal support pocket in accordance with the invention in a closed condition.

The left and right flaps 44 and 46 are established with an end integrally extending from the left and right sides of the pouch along the width of material thereof, and free edges encircling between the front and back associated sides of the pouch. As shown in FIG. 2, the left and right flaps extend upwardly from the left and right upper quadrants of the generally semi-circular pouch, terminate in free ends that overlap in the lateral center of the front panels at a position proximate, to above, the top of the openings 30, 32, and are configured to lay flat against the inside of the front panels. When in this position, the flaps cooperate with the back gathered elastic edge 50 of the pouch 42 to define a center elastic curved opening 70 into the pouch from the back side thereof.

For opening and closing the pocket 40, and ease of entry into and exit from the pouch 42, the pocket is provided with a unique closure configuration involving the flaps 44, 46 and the inside front panel 26 of the brief. The flaps are shown folded over and fully open in FIG. 3, and partially open in FIG. 4. The left flap is shown snapped to the front inside panel in FIG. 5. The flaps are shown closed in FIG. 2, with the left flap snapped to the inside front panel, and the right flap snapped to the left flap.

Figure 3:
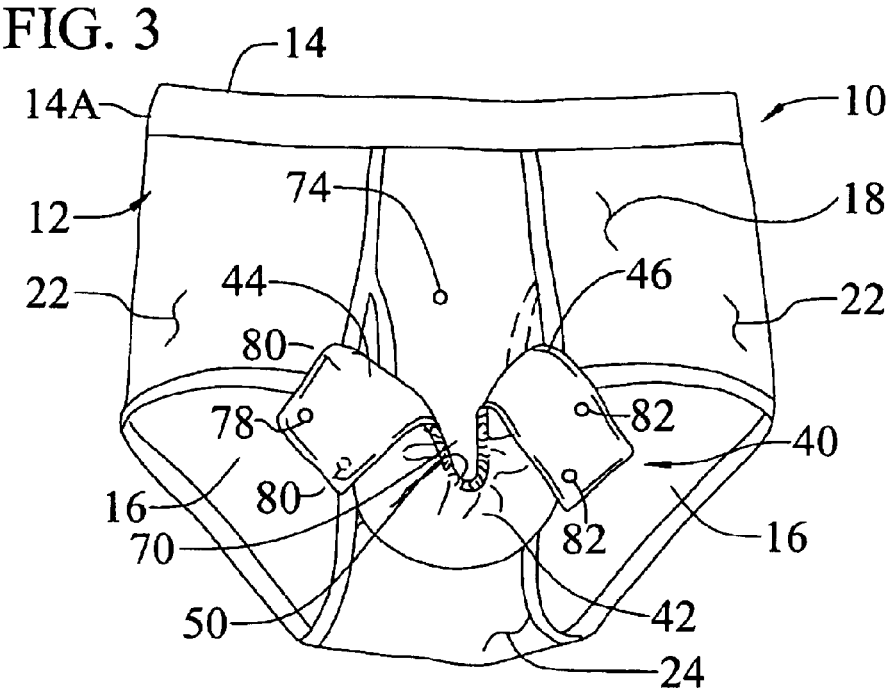
FIG. 3 is a view similar of FIG. 2 but showing flaps of the support pocket folded inwardly to a full open position, and showing a 2-part snap closure for connecting one flap to the front of the main body of the brief.
Figure 4:
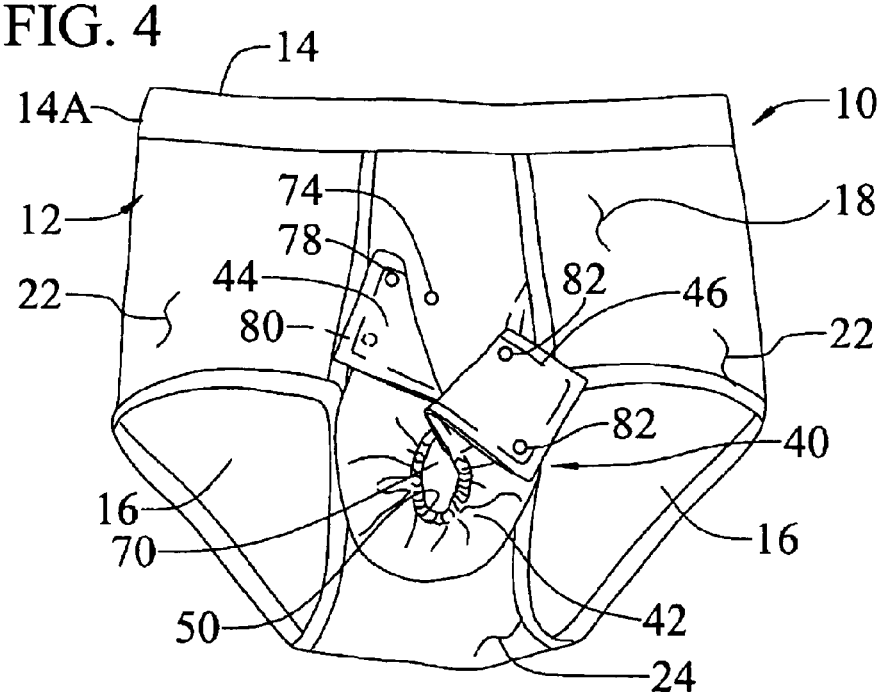
FIG. 4 is a view similar to FIG. 3 but with the flaps folded part way forward towards the closed position.

In carrying out this aspect of the invention, a female snap part 74 is connected to the inside front panel 26, facing inwardly (i.e., outwardly from the page and towards the viewer as presented in the inside FIGS. 2–5), at a height approximately midway up the front panel, proximate, to above, the top of the openings 30, 32. FIGS. 3 and 4 are inside front views of the brief, with the flaps shown open and exposing the female snap part 74. The outside (front side) of this snap part is hidden between the two layers of fabric comprising the inside and outside front panels of the brief (see e.g., FIG. 6). Consequently, as can be seen in FIG. 1, the outside of this female snap part 74 is hidden on the outside of the brief by the outside front panel.

Referring again to FIGS. 3 and 4, a male snap part 78 is secured to the outside layer of the left flap 44, at a position proximate the upper end of the flap. This male snap part 78 faces outwardly (i.e., inwardly into the page and away the viewer as presented in the inside views in FIGS. 3–5) with the flap in its normal position against the inside front panel and is positioned for snapping into the female snap part 74 on the inside front panel. As will be seen in FIG. 5, in which the male snap part 78 is shown with a dashed circle, and in the side cross-sectional view of FIG. 6A, the inside (back side) of the male snap part 78 is hidden by the inside layer of the left flap.

Figure 5:
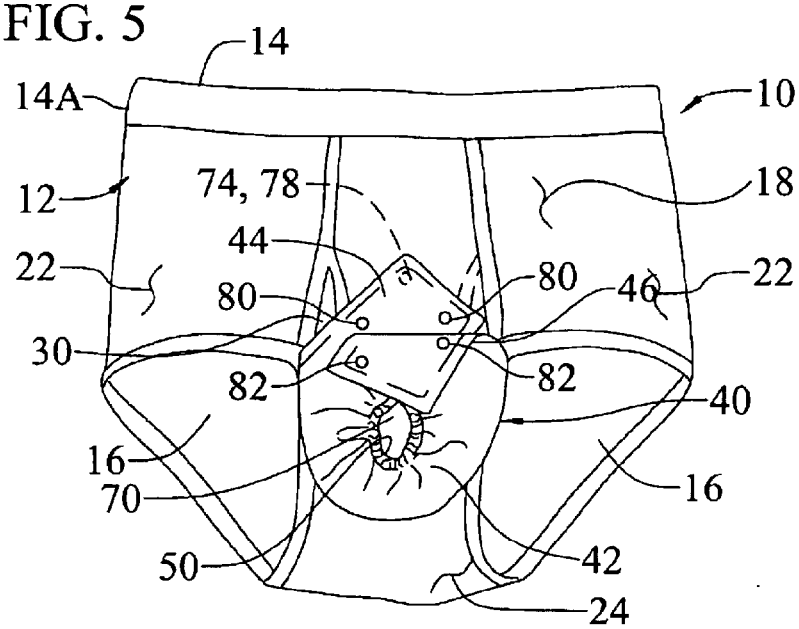
FIG. 5 is a view similar to FIG. 3 but with the one flap snapped into its closed position against the front of the brief and the other flap folded open for viewing the 2-part closure for connecting the flaps together.

As also shown in FIG. 5, a pair of female snap parts 80 are secured to inside layer of the left flap 44. These female snap parts 80 are laterally spaced from one another and face inwardly with the flap in it normal position along side the inside front panel and snapped into the female snap part 74. As seen in FIGS. 3 and 4, in which these female snap parts 80 are shown with dashed circles, and in the side cross-sectional view of FIG. 6A, the outside of these female snap parts 80 are hidden by the outside layer of the flap, and as will become evident, are therefore prevented from contact with the wearer's penis when the pocket in the closed position.

Referring again to FIGS. 3–5, a pair of male snap parts 82 are secured, operatively facing outwardly, to the outside layer of the right flap 46. These male snap parts 82 and are laterally spaced for snapping into the pair of female snap parts 80 of the left flap 44 with the right flap overlaying the left flap as shown in FIG. 2. The inside of these male snap parts 82 are hidden between the layers of the right flap (see FIGS. 2 and 6A), and therefore, are prevented from contact with the wearer's skin.

Figure 6A:
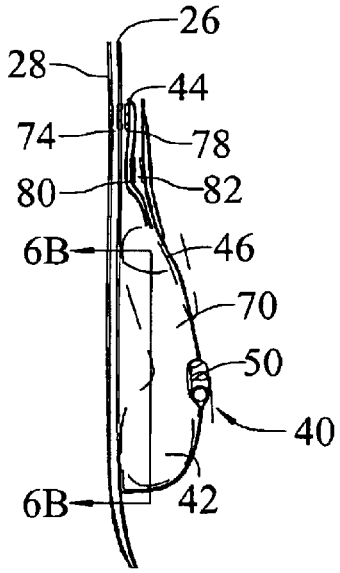
FIG. 6A is a side cross-sectional view of the brief taken along the line 6A—6A of FIG. 2, and showing the flaps closed and the wearer's scrotum and penis in dashed lines in support and protected position in the pocket.
Figure 6B:
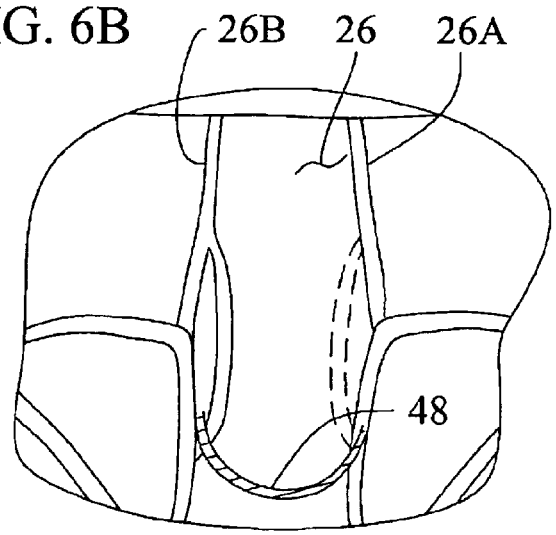
FIG. 6B is a cross-sectional view of the inside front panel of the brief taken along the line 6B—6B of FIG. 6A.
Figure 7:
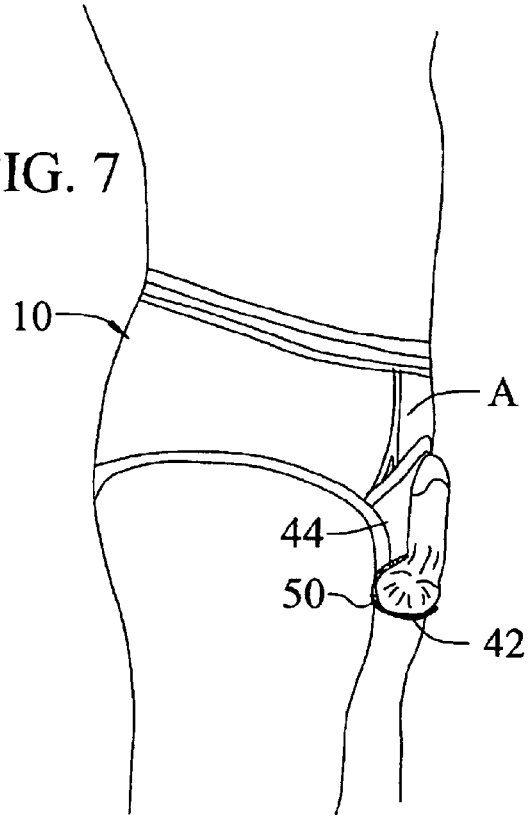
FIG. 7 is a side view of the brief as worn, but with the front panel of the main body not shown for viewing the pocket in closed, supporting position protecting the wearer's scrotum and penis from the wearer's body.
Figure 8:
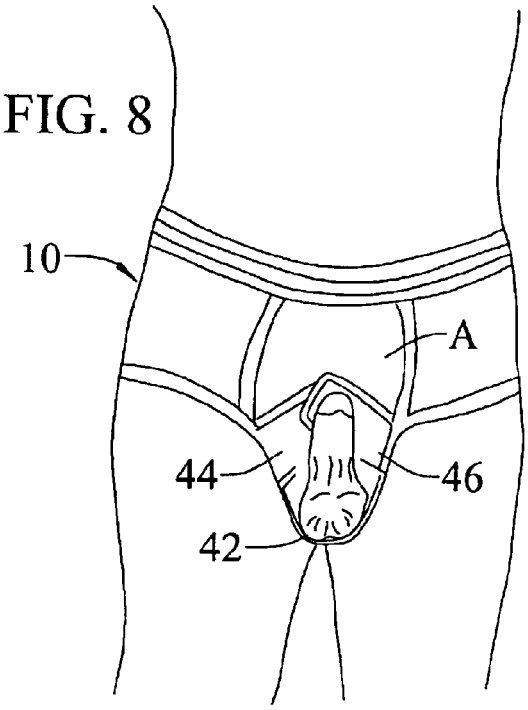
FIG. 8 is a front view of the brief as worn in FIG. 7, with the front panel again not shown for viewing the pocket in its closed, supporting, protecting position.
Figure 9:
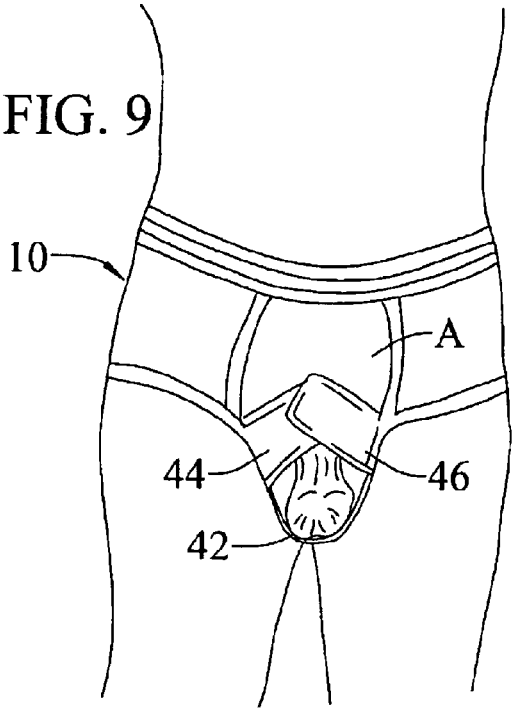
FIG. 9 is a front view similar to FIG. 8, but showing an alternate technique for wearing the brief.

With the foregoing arrangement, the support pocket 40 of the brief 10 is utilized by opening the flaps 44, 46 as generally shown in FIG. 3, positioning the scrotum downwardly through the opening 70 and into the pouch 42, with the back edge 50 of the pouch under the connected back of the scrotum, and the penis resting against the front panel 26. The left flap 44 is then snapped to the front panel 26 (FIG. 5), and the right flap 46 snapped to the left flap to close the pocket 40 (FIGS. 2 and 6A). As shown in FIGS. 6A–8, with the pocket closed, the pouch 42 provides support under the wearer's scrotum, and the penis is protected between the front panels 26, 28 and the flaps 44, 46. Wearing the briefs in this manner, with the penis outside the flaps, away from the body, gives support for the penis, keeps the wearer cooler, and prevents skin-to-skin contact to protect from chaffing. Alternately, as shown in FIG. 9, the wearer can position his penis inside the flaps, depending on the type of comfort he desires. This position prevents rubbing and chafing in the area where the base of the penis meets the scrotum. Either position can be used, depending on the wearer's structure and preference.

Figure 10:
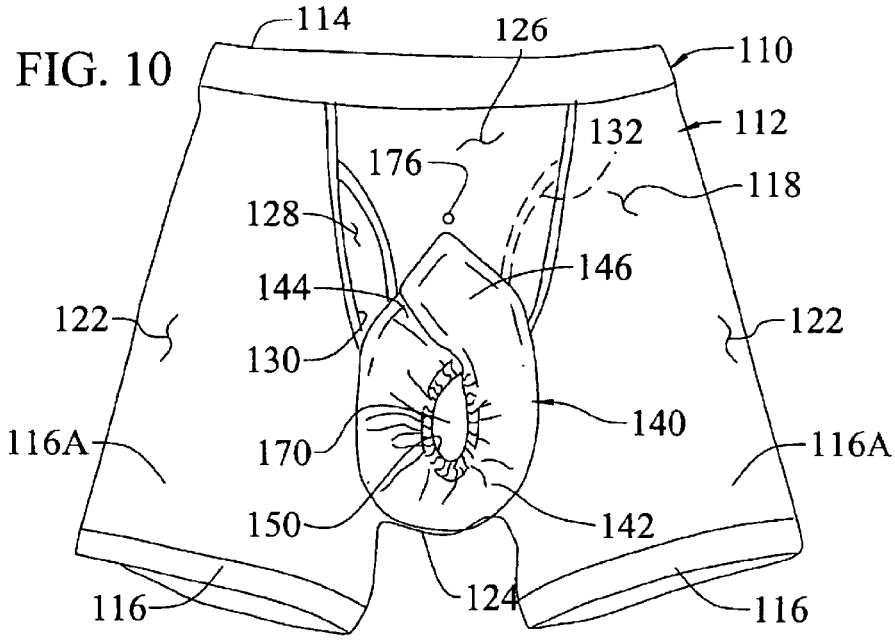
FIG. 10 is an inside front view similar to FIG. 2 of an alternate embodiment brief provided with an alternate internal support pocket and closure arrangement in accordance with the invention.
Figure 11:
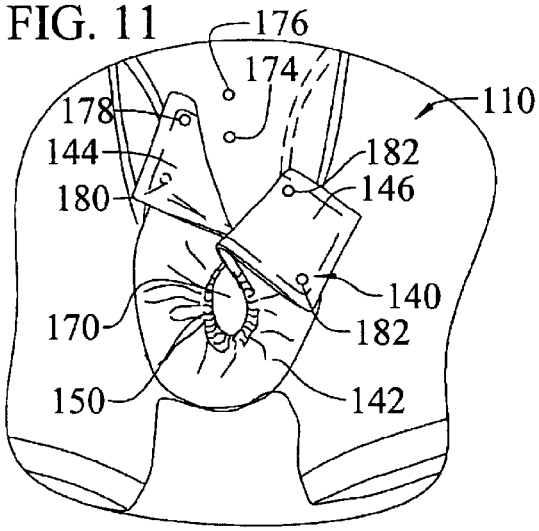
FIGS. 11–12 are partial front views similar to FIGS. 4–5 of the alternate brief and support pocket shown in FIG. 10.
Figure 12:
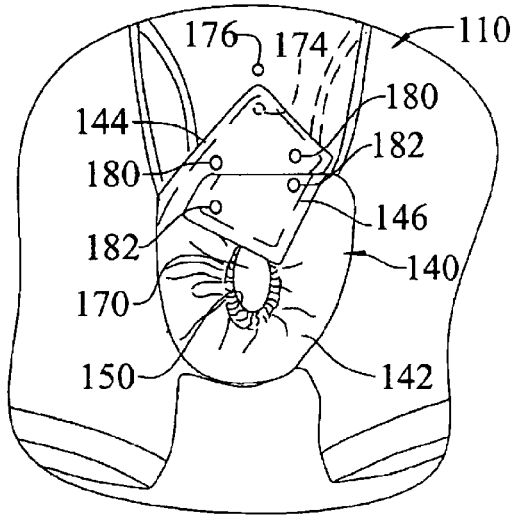

An alternate embodiment brief in accordance with the invention is shown in FIGS. 10–12 in boxer brief 110. The boxer brief is constructed similar to brief 10, includes all of the parts and components of a conventional boxer brief, and appears the same as a conventional boxer brief from the outside. The boxer brief 110 also includes an inner support pocket 140 with the same parts and components as support pocket 40 in brief 10 described above, except for provision of an additional female snap part. Reference numerals shown in the drawings for the boxer brief 110 correspond to reference numerals used for similar parts in brief 10 described above, but are incremented by 100.

Accordingly, the boxer brief 110 includes a main body 112 with an elastic upper waist opening 114 and a pair of lower leg openings 116. The main body is established with a front panel section 118, a back panel section (hidden from view), a pair of side panel sections 122, and a bottom panel section 124. The front, back and side panel sections encircle the wearer, and the bottom panel section is connected between the front and back panel sections to close the center, bottom of the brief. In the boxer brief, the side panels extend below the bottom panel to establish short leg sections 116A.

The front panel section 118 is provided with an inside panel 126, and an outside panel 128 that overlaps the inside panel. The inside and outside front panels are sewn as described above to establish an inside opening 130 at the lower side of the inside panel and an outside opening 132 at the opposite lower side of the outside panel, such that the overlapping front panels and the associated openings 130 and 132 cooperate to establish the openable front flaps of the brief.

In accordance with the invention, the inner support pocket 140 is provided on the inside of the brief 110 as shown in the inside views of the brief in FIGS. 10–12. The support pocket 140 includes a lower pouch 142, and a pair of upper flaps 144 and 146 that extend upwardly from opposite sides of the pouch. The support pocket is made from soft, conformable fabric, such as comfortable cotton blend material of the type typically used in men's conventional briefs, with the flaps being made from a double layer of material. The pouch 142 is established with a strip of material of substantially constant width to provide a front edge as described above and a back edge 150. The front edge of the pouch is sewn along a generally semi-circular curvature that extends downwardly, arcuately sideways, and then curving back upwardly along the front panels to generally encircle, on the sides and below, the inside and outside openings 130, 132. An elastic strip is sewn into the back edge 150 of the pouch to draw the back edge upwardly and create the pouch form noted above.

The left and right flaps 144 and 146 extend integrally upwardly from the left and right sides of the pouch, and terminate in free ends that overlap in the lateral center of the front panels at a position proximate to above the upper edge of the openings 130, 132. When in this position, the flaps cooperate with the back gathered edge 150 of the pouch 142 to define a center elastic curved opening 170 into the pouch from the back side thereof.

To open and close the support pocket 140, a pair of female snap parts 174 and 176 (FIG. 14) are connected to the inside front panel 126, facing inwardly, at a height approximately midway up the front panel, proximate to above the top of the openings 130, 132. A male snap part 178 is secured to the outside layer of the left flap 144 for snapping into the female snap parts 174 and 176 on the inside front panel. A pair of laterally spaced female snap parts 180 are secured to inside layer of the left flap to face inwardly with the flap in its normal position snapped to the inside front panel. And a pair of male snap parts 82 (FIG. 12) are secured, facing outwardly, to the outside layer of the right flap for snapping into the pair of female snap parts 80 of the left flap. Additional components and aspects of the brief 110 are as described connection with brief 10.

This alternate configuration support pocket 140 of brief 110 is worn the same as support pocket 40, with the same unique features and advantages, except that the left flap 144 can be snapped to either the top female snap part 176 or the bottom female snap part 174 depending on the type of support that is desired. Snapping the left flap to the top female snap part will provide firmer pouch support, whereas snapping the left flap to the lower female snap part will provide a more relaxed support, and support for the larger wearer. In either case, the pocket provides unique support for the wearer, prevents chaffing, and reduces warmth and moisture problems of conventional briefs.

Figure 13:
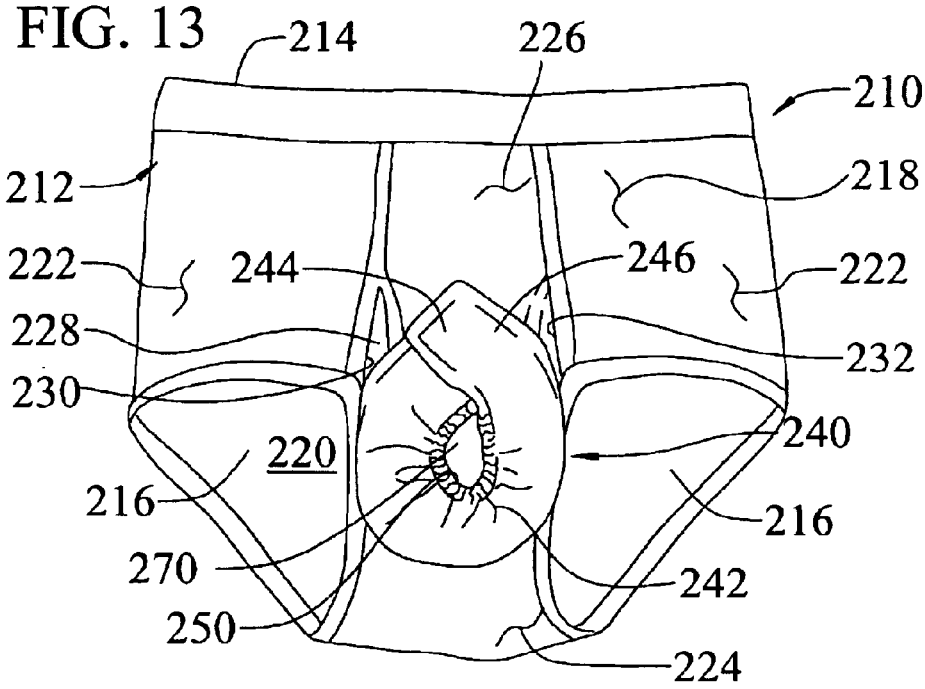
FIG. 13 is an inside front view similar to FIG. 2 of the brief shown therein provided with a second n alternate internal support pocket in accordance with the invention.
Figure 14:
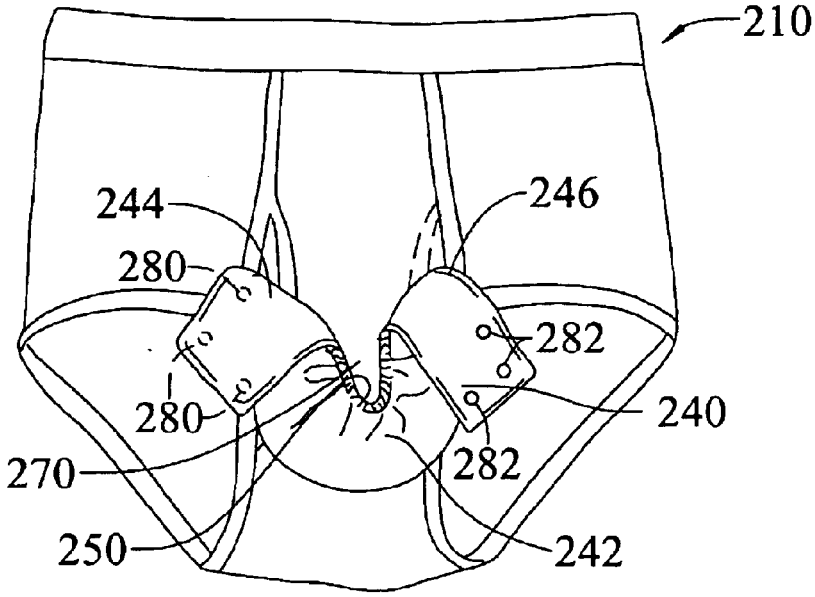
FIG. 14 is an inside view of the brief shown in FIG. 13 with the support pocket shown therein in its full-open position.

A second alternate embodiment brief 210 in accordance with the invention is shown in FIGS. 13–14. This brief is constructed similar to brief 10, and includes all of the same parts and components as brief 10, except that the flaps of the inner support pocket do not connect to the inside front panel of the brief. Reference numerals shown in the drawings for the brief 210 correspond to reference numerals used for similar parts in brief 10 described above, but are incremented by 200.

Accordingly, the brief 210 includes a main body 212 with an elastic upper waist opening 214 and a pair of lower leg openings 216. The main body is established with a front panel section 218, a back panel section 220, a pair of side panel sections 222, and a bottom panel section 224. The front panel section 218 is provided with an inside panel 226 and an outside panel 228 that overlaps the inside panel. The edges of the front panels are sewn to establish inside opening 230 and outside opening 232.

In accordance with the invention, the inner support pocket 240 is provided on the inside of the brief 210. The support pocket 240 includes a lower pouch 242 and a pair of upper flaps 244 and 246 as described above in connection with pouch 42, and flaps 44 and 46 to establish, among other things, the pouch elastic back edge 250 the opening 270 into the pouch.

To open and close the pocket 240, three triangularly positioned female snap parts 280 (shown in dashed lines in FIG. 12) are connected to the outside layer of the double-layer left flap 244, facing inwardly when the flap is positioned against the front of the brief, and three male snap parts 282 are secured to the inside layer of the double-layer right flap 246, facing outwardly for snapping into the female snap parts 280. This second alternate configuration support pocket 240 is worn the same as support pocket 40, except that the flaps do not connect to the inside panels of the brief. Consequently, the second alternate brief provides relaxed support for the wearer, while preventing chaffing, and reducing warmth and moisture problems of conventional briefs. Those skilled in the art will recognize that additional alternate embodiment briefs may be provided in accordance with the invention.

From the foregoing, it will be understood that the present invention brings to the art a new men's brief that includes a unique inner support pocket for improved support and cooling, and reduces the potential for chaffing, while maintaining the normal functionality and conveniences of conventional men's brief to which men have become accustomed.

I claim:

1. A man's brief comprising:

a) a conventional main body with an upper elastic waist opening, a pair of laterally spaced lower leg openings, and a front including overlapping panels connected to establish offset front openings for conventional access when wearing the brief; and b) an inside support pocket with:

i) a lower conformable pouch connected to the inside front of the main body, a) the pouch extending around approximately 180 degrees between opposite sides when viewed from behind to establish an upwardly curved open pouch, b) the pouch having an elastic back edge extending substantially around said 180 degrees to establish a lower elastic perimeter of an opening to the pouch from behind, ii) a pair of flaps extending upwardly from the opposite sides of the pouch, a) the flaps being positionable between (1) a closed position overlapping one another and laying flat against the front panels of the main body generally above the pouch, and (2) an open position separated laterally from one another to open the pouch from above, b) the flaps having inside edges facing each other and extending upwardly from the elastic perimeter of the pouch to establish an upper perimeter of said opening with the flaps in said closed position, and iii) a two-part releasable closure, with complimentary parts connected to each of the flaps, to enable opening and closing the flaps, and thereby opening and closing the pouch for entry from above.

2. The man's brief as defined in claim 1 in which the closure comprises complimentary male and female snap parts.

3. A man's brief comprising:

a) a conventional main body with an upper elastic waist opening, a pair of laterally spaced lower leg openings, and a front including overlapping panels connected to establish offset front openings for conventional access when wearing the brief; and b) an inside support pocket with:

i) a lower conformable pouch connected to the inside front of the main body, a) the pouch extending around approximately 180 degrees between opposite sides when viewed from behind to establish an upwardly curved open pouch, b) the pouch having an elastic back edge extending substantially around said 180 degrees to establish a lower elastic perimeter of an opening to the pouch from behind, ii) a pair of flaps extending upwardly from the opposite sides of the pouch, a) the flaps being positionable between (1) a closed position overlapping one another and laying flat against the front panels of the main body above the pouch, and (2) an open position separated laterally from one another and rearwardly from the front of the body to open the pouch from above, b) the flaps being formed with a double thickness fabric establishing separate fronts and backs thereof, c) the flaps having inside edges facing each other and extending upwardly from said elastic perimeter to establish an upper perimeter of said opening with the flaps in said closed position, iii) a first two-part releasable closure, with complimentary parts connected to the front of one of said flaps and the inside front of the main body at a position above the pouch, to enable opening and closing said flap in relation to said one panel, and thereby opening and closing one side of the pouch from above, and iv) a second two-part releasable closure, with complimentary parts connected to the back of said one flap and to the front of the other flap, to enable opening and closing the flaps in relation to one another and the other side of the pouch from above.

4. The man's brief as defined in claim 3 in which the closures comprise complimentary male and female snap parts.

5. The man's brief as defined in claim 3 further comprising an additional snap part connected to the inside front panel of the main body at a position above said complimentary part connected thereto for optional connection of the snap part of said first closure connected to said one flap thereto.

6. The man's brief as defined in claim 3 further comprising a third two-part closure, with complimentary parts connected to the back of said one flap and to the front of the other flap laterally spaced from said second closure, for opening and closing opposite sides of the flaps in relation to one another.

7. A man's brief comprising:

a) a conventional main body with an upper elastic waist opening, a pair of laterally spaced lower leg openings, and a front including overlapping panels connected to establish offset front openings for conventional access when wearing the brief; and b) an inside support pocket with:

i) a lower conformable pouch connected to the inside front of the main body, a) the pouch extending around approximately 180 degrees between opposite sides when viewed from behind to establish an upwardly curved open pouch, b) the pouch having an elastic back edge extending substantially around said 180 degrees to establish a lower elastic perimeter of an opening to the pouch from behind, ii) a pair of flaps extending upwardly from the opposite sides of the pouch to terminating ends, a) the ends of the flaps being positionable between (1) a closed position overlapping one another and laying flat against the front panels of the main body above the pouch, and (2) an open position separated laterally from one another to open the pouch from above, b) the ends of the flaps being formed with a double thickness fabric establishing separate fronts and backs thereof, c) the flaps having inside edges facing each other and extending upwardly from said elastic perimeter to establish an upper perimeter of said opening with the flaps in said closed position, iii) a first two-part releasable closure, with complimentary parts connected to the front of one of said flap ends and the inside front panel of the main body at a position above the pouch, to enable opening and closing said flap end in relation to said one panel, and thereby opening and closing one side of the pouch for entry from above, and iv) second and third two-part releasable closures, with complimentary parts connected to the back of said one flap and to the front of the other flap in lateral spaced relation, for opening and closing laterally spaced sides of the flap ends in relation to one another and in relation to the pouch from above.

8. The man's brief as defined in claim 7 in which the closures comprise complimentary male and female snap parts.

9. The man's brief as defined in claim 8 further comprising an additional snap part connected to the inside front panel of the main body at a position above said complimentary part connected thereto for optional connection of the snap part of said first closure connected to said one flap thereto.

10. The man's brief as defined in claim 7 further comprising a third two-part closure, with complimentary parts connected to the back of said one flap and to the front of the other flap laterally spaced from said second closure.

* * * * *